United States Patent [19]

Lukens, Jr.

[11] Patent Number: 4,759,677

[45] Date of Patent: Jul. 26, 1988

[54] TRANSFER TABLE SYSTEM

[75] Inventor: J. Paul Lukens, Jr., Perkasie, Pa.

[73] Assignee: Phillocraft Company, Montgomeryville, Pa.

[21] Appl. No.: 93,127

[22] Filed: Sep. 3, 1987

Related U.S. Application Data

[63] Continuation of Ser. No. 817,989, Jan. 13, 1986, abandoned.

[51] Int. Cl.[4] ..... B26D 7/01

[52] U.S. Cl. ..... 414/676; 83/29; 83/925 CC; 414/353

[58] Field of Search ..... 414/114, 349, 351, 352, 414/353, 390, 676; 406/39, 88, 89; 105/215 C; 104/48, 50; 83/29, 402, 925 CC; 198/300, 302, 303; 270/30, 31

[56] References Cited

U.S. PATENT DOCUMENTS

| | | | |
|---|---|---|---|
| 2,815,249 | 12/1957 | Curtenius | 414/676 |
| 3,006,454 | 10/1961 | Penn | 198/302 |
| 3,017,041 | 1/1962 | Hawkes et al. | 414/114 |
| 3,052,341 | 9/1962 | Sheehan | 198/302 |
| 3,254,376 | 6/1966 | Burnett | 104/48 X |
| 3,532,481 | 10/1970 | Chaumont | 414/676 X |
| 3,588,088 | 6/1971 | Reiners et al. | 414/676 |
| 3,776,074 | 12/1973 | Pearl et al. | 83/925 CC X |
| 4,514,246 | 4/1985 | Forrer | 83/925 CC X |
| 4,566,837 | 1/1986 | Shiomi et al. | 104/48 X |

*Primary Examiner*—Leslie J. Paperner

*Attorney, Agent, or Firm*—Steele, Gould & Fried

[57] ABSTRACT

A transfer table system includes a plurality of stationary work tables positioned with their respective longitudinal axes in parallel spaced relationship and a transfer table movable into end to end juxtaposition with the work tables. The transfer table and the work tables each include a boundary layer of pressurized air above the table top to facilitate the transfer of previously stacked layers of cloth between the work tables and the transfer table.

2 Claims, 4 Drawing Sheets

FIG.4
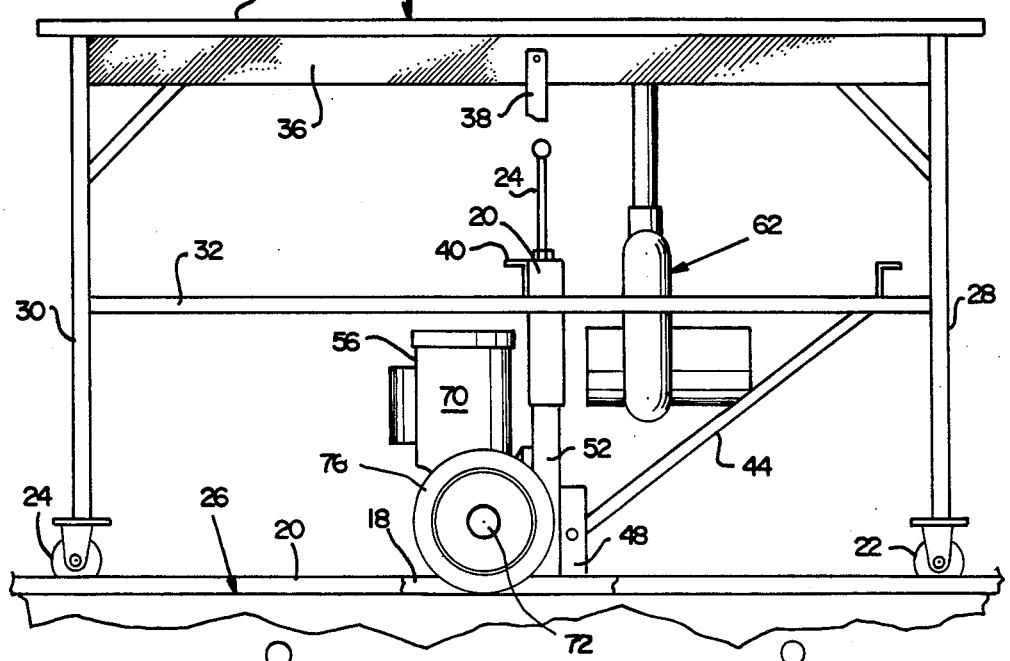
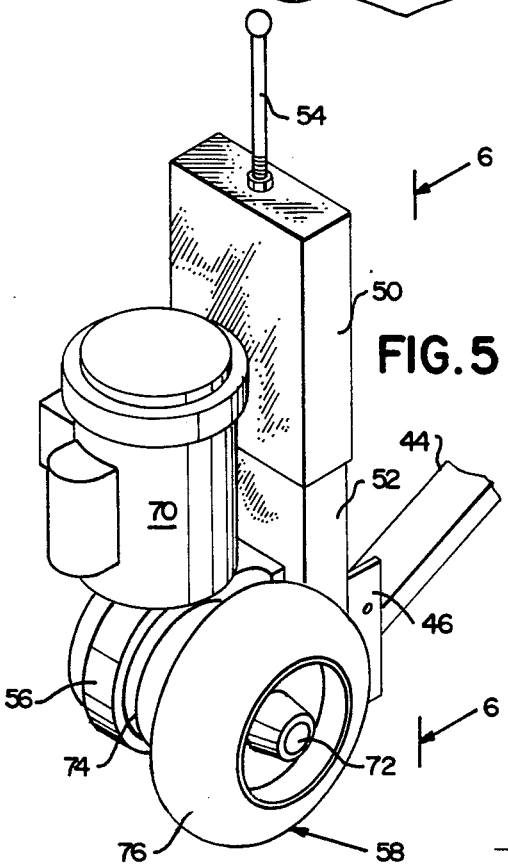
FIG.5
FIG.6
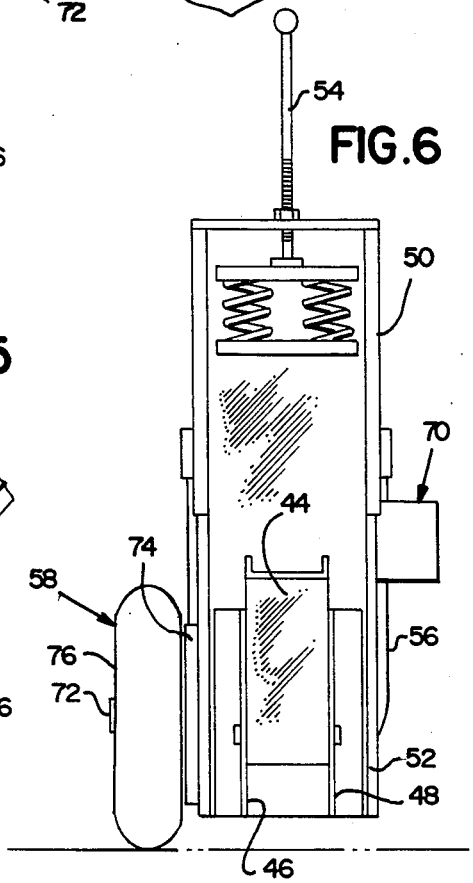

TRANSFER TABLE SYSTEM

This is a continuation of application Ser. No. 817,989, filed Jan. 13, 1986, abandoned.

BACKGROUND OF THE INVENTION

1. Field of the Invention

The present invention relates generally to the field of elongated spreading and cutting tables for use in the garment manufacturing industry, and more particularly, relates to a mobile, air-equipped transfer table suitable for moving multiple layers of spread and/or cut fabric between stationary, similar air-equipped work tables.

2. Description of the Prior Art

In the garment manufacturing industry, in order to increase production rates and to decrease production costs, most major manufacturers have been employing elongated, sturdy, modular work tables for use in spreading the fabric in layers, in cutting the multi-layers of spread fabric into configured patterns and in bundling the cut patterns for delivery to a plurality of sewing machines. In further efforts to reduce manufacturing costs by reducing the number of attendants required and to permit easy and rapid movement of the stacked layers of fabric from one table to another table, the prior art modular cutting tables have recently been modified by equipping such tables with forced air means.

In the latest such air-equipped tables, the top of each table has been provided with a plurality of equally spaced holes and forced air produced by a suitable air pump system has been designed to be equally applied across the entire table surface through the air holes. In such an arrangement, a boundary layer of air forms intermediate the top surface of the table and the bottom layer of the stacked fabric in a manner to allow substantially weightless movement of heavy fabric spreads over the table, through guidance of but a single worker. One such air-equipped work table has previously been designed by the present applicant and is fully described in co-pending application Ser. No. 749,453 filed June 27, 1985, now U.S. Pat. No. 4,702,664, and entitled "Air-Equipped Table". One such air-equipped work table is presently being manufactured and sold by the assignee of the present application under the trademark "AIR-TEX".

SUMMARY OF THE INVENTION

The present invention relates generally to the field of air assisted, modular, elongated spreading and cutting tables, and more particularly, is directed to a mobile air assisted, transfer table suitable for controlled movement adjacent to a plurality of stationary, spaced, elongated, air assisted work tables.

The air-equipped transfer table of the present invention comprises an elongated, modular steel frame which supports a table top having a plurality of equally spaced small air holes or openings extending through the surface of the table top. An air pump is provided to feed a suitable plenum chamber in the manner described in the said co-pending application Ser. No. 749,453 to substantially equally pressurize all of the small holes. The pressurized air provides a boundary layer of air between the table top surface and the under surface of the spread layers of fabric.

It is contemplated that the transfer table of the present invention will find particular utility in the garment manufacturing industry wherein a plurality of at least two and preferably three elongated, modular, air-equipped work tables are positioned in side by side relationship. The work tables are utilized to perform the usual initial garment manufacturing operations of spreading the fabric from a large roll to provide a plurality of as many as one hundred and fifty layers on a spreading table, cutting the predesigned pattern configurations through the spread layers on a cutting table and then bundling the cut patterns on a third, bundling table for subsequent delivery to the sewing machines.

In order to provide maximum utilization of the costly spreading equipment and pattern cutting equipment, the transfer table of the present invention is designed to be easily movable from a position adjacent to the spreading table to a position adjacent to the cutting table and thence to a position adjacent to the bundling table. By providing air assisted means as part of the permanent work tables and as a part of the mobile transfer table, a single workmen, by using the zero weight advantage provided by the air assistance, can move the stacked layers from table to table in a relatively quick and easy manner.

For example, after the costly, automatic spreading equipment is utilized to spread the fabric layers upon the spreading table, the mobile table can be positioned in end to end juxtaposition to the spreading table. Then by activating the air systems in each of the spreading table and the transfer table, a single workmen can conveniently move the entire layered spread from the spreading table to the transfer table. This then would immediately free the spreading table to enable the spreading equipment to again begin spreading layered fabric upon the table without having to await the completion of other operations. With the previously layered spread transfered onto the transfer table, the transfer table gearmotors can then be energized by the same operator to move the transfer table to a position in longitudinal juxtaposition to the cutting table. The spread can then be transferred by the operator from the transfer table to the cutting table by again utilizing the air systems in both tables. After the desired patterns have been cut in the layered fabric on the cutting table, the entire cut spread can be again moved to the transfer table, thereby leaving the cutting table free to receive another layered spread for pattern cutting purposes in a manner to minimize down time of the table and to maximize efficient use of the cutting equipment.

With the desired pattern cut in the layered spread, the transfer table can then be moved into end to end juxtaposition to a bundling table. With the transfer table and the bundling table so positioned, the material can then be moved from the transfer table to the bundling table by a single operator utilizing the air assistance of both tables wherein the necessary bundling operations can be performed in the usual manner. At this stage of the operations, the transfer table will be available to be moved to a position adjacent to any of the other work tables.

It is a primary object of this invention to provide a self contained table propelling system in a transfer table to easily permit a single operator to move the transfer table to a desired location adjacent to the spreading, cutting and bundling tables.

It is another object of the present invention to provide an improved mobile transfer table having a built-in air assistance means together with integral floor contacting propelling means to facilitate movement of the transfer table and the transfer of the material by a single operator.

It is another object of the present invention to provide a novel, elongated, air assisted transfer table including means to move the transfer table relative to fixed work tables, means to form a boundary layer of pressurized air at the transfer table surface and guide means to guide the transfer table between stationary work tables comprising a spreading table, a cutting table and a bundling table.

It is another object of the present invention to provide a novel, elongated, air-equipped transfer table that is rugged in design, modular in construction and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 4 is an enlarged, elevational view looking from line 4—4 on FIG. 1 in the direction of the arrows, and partially broken away.

FIG. 5 is an enlarged, partial, perspective view showing the gearmotor drive.

FIG. 6 is an elevational view of the gearmotor of FIG. 5 looking from lines 6—6.

DESCRIPTION OF THE PREFERRED EMBODIMENT OF THE INVENTION

Figure 1:
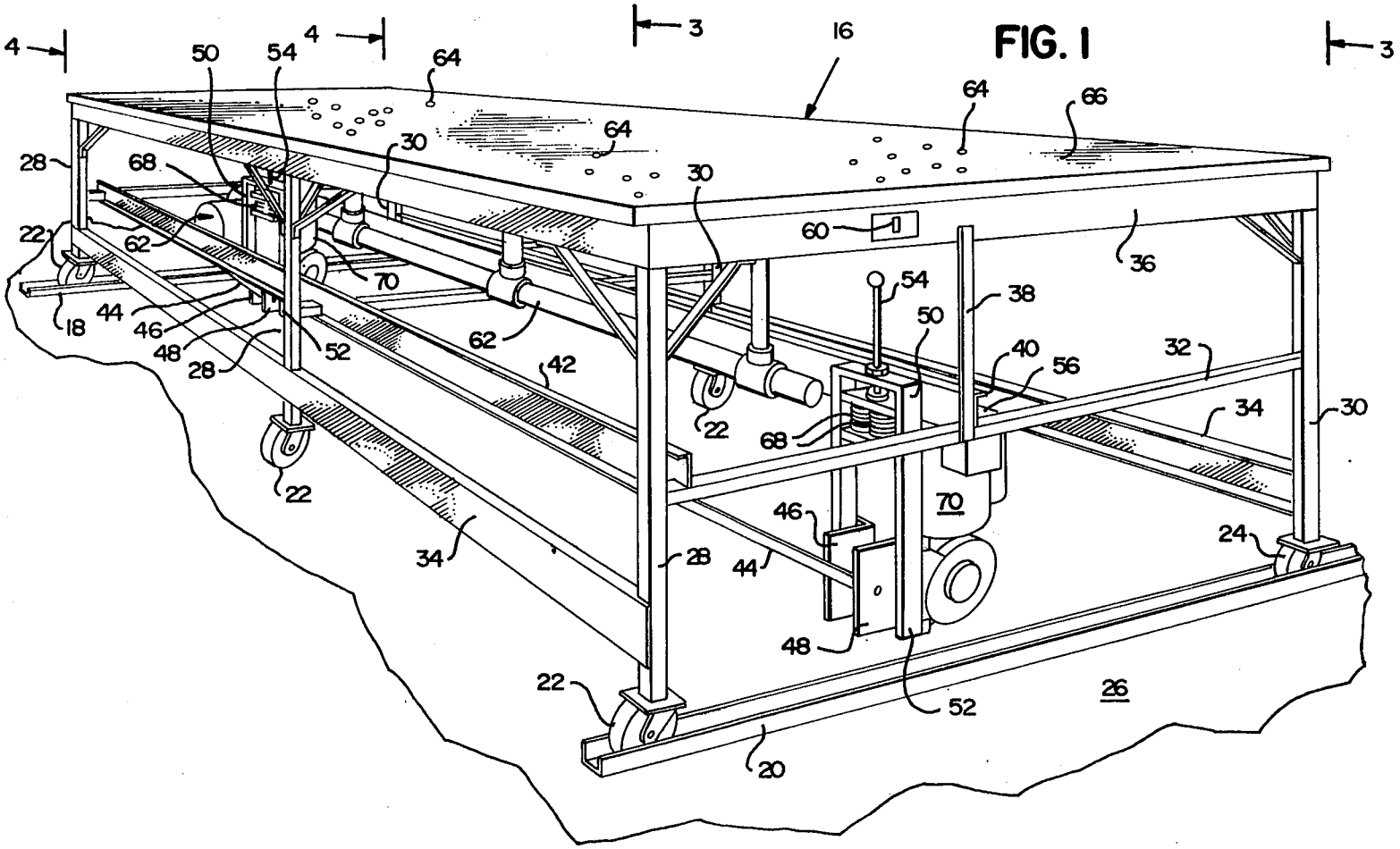
FIG. 1 is a perspective view of an air-equipped mobile transfer table constructed in accordance with the present invention.

Although specific terms are used in the following description for the sake of clarity, these terms are intended to refer only to the particular structure of the invention selected for illustration in the drawings, and are not intended to define or limit the scope of the invention.

Figure 2:
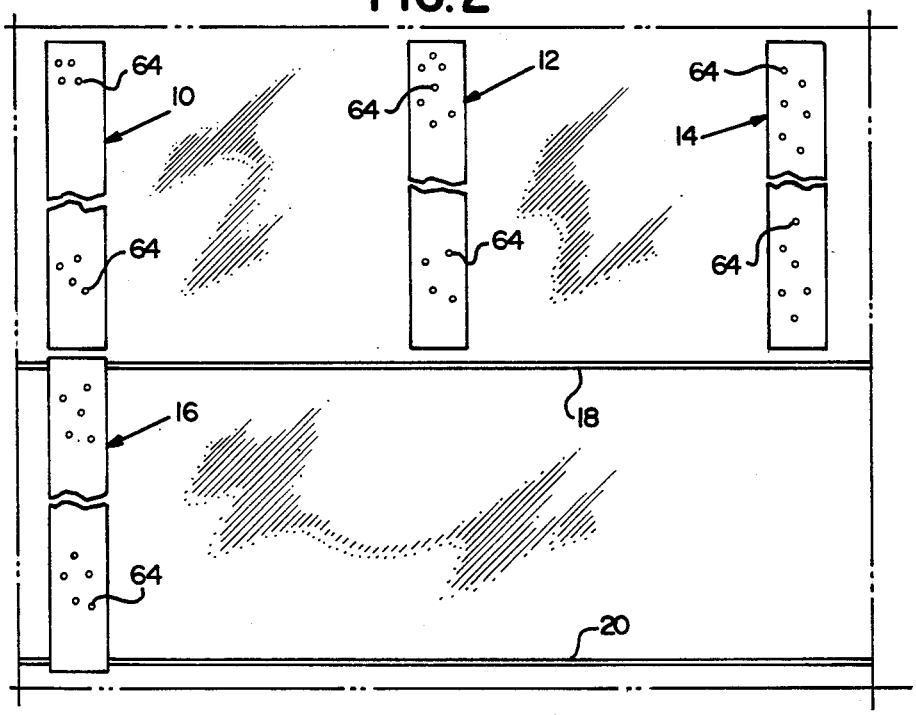
FIG. 2 is a schematic representation of a portion of a garment manufacturing installation including a spreading table, a cutting table, a bundling table and a transfer table that is movable into end to end juxtaposition with each of the other tables.

Referring now to the drawings, there is illustrated schematically in FIG. 2 a portion of a garment manufacturing facility wherein a spreading table 10, a cutting table 12 and a bundling table 14 are positioned upon the work shop floor 26 in side by side juxtaposition. It is contemplated that each of the tables 10, 12, 14 will be of the so-called air table design wherein a blower system 62 is installed to provide a pressurized air layer at each table surface by delivering a quantity of pressurized air to each of a plurality of openings 64 provided through the table top surface 66. The tables 10, 12, 14 may be similar to the air-equipped table manufactured and sold by The Phillocraft Company, Inc., Montgomeryville, Pa., the assignee of the present application under the trademark "AIR-TEX".

In a longitudinally juxtaposed position to the work tables 10, 12, 14 is provided the novel transfer table 16 (FIG. 1) of the present invention which is designed to transversely move along the longitudinally spaced floor tracks 18, 20 into longitudinally juxtaposed relationship to each of the work tables. The transfer table 16 is similar in construction to the work tables 10, 12, 14 except that the table legs 28, 30 are provided with floor contacting wheels 22, 24 to allow the transfer table 16 to be moved over the floor 26 along the floor tracks 18, 20. The transfer table 16 includes a blower system 62 which feeds pressurized air through the table top surface 66 in known manner through the plurality of table top openings 64.

In accordance with present practice, it is contemplated that the spreading table 10 will be equipped with automatic fabric spreading equipment (not shown) and that the cutting table 12 will be equipped with a semi-automatic or automatic servo type cutter (not shown) in accordance with the latest engineering technology in the art. Inasmuch as the automatic spreaders and the automatic cutting equipment are presently extremely costly, it is a primary object of the present invention to render such equipment cost effective by allowing the spreading table to be used substantially continuously for spreading and the cutting table to be used substantially continuously for cutting. In this manner, maximum utilization of the costly spreading and cutting equipment can be achieved. That is, by moving the multi-layered fabric after it is spread from the spreading table 10 to the transfer table 16, the spreading table 10 will then again be free to permit the spreading equipment to be immediately employed for providing additional layers on the spreading table, without having to wait for cutting operations or the bundling operations to take place. Similarly, the utilization of the cutting equipment associated with the cutting table 12 can be maximized by allowing cutting of the patterns to take place on the cutting table simultaneously with the spreading on the spreading table 10 or the bundling on the bundling table.

Figure 3:
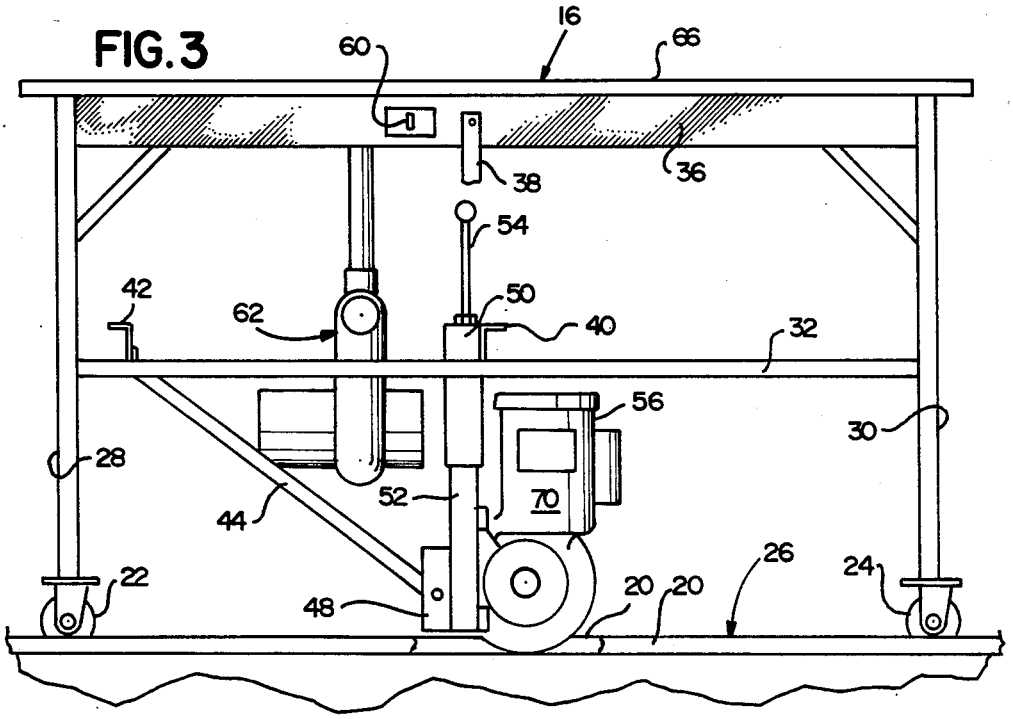
FIG. 3 is an enlarged, elevational view looking from line 3—3 on FIG. 1 in the direction of the arrows and partially broken away.
Figure 7:
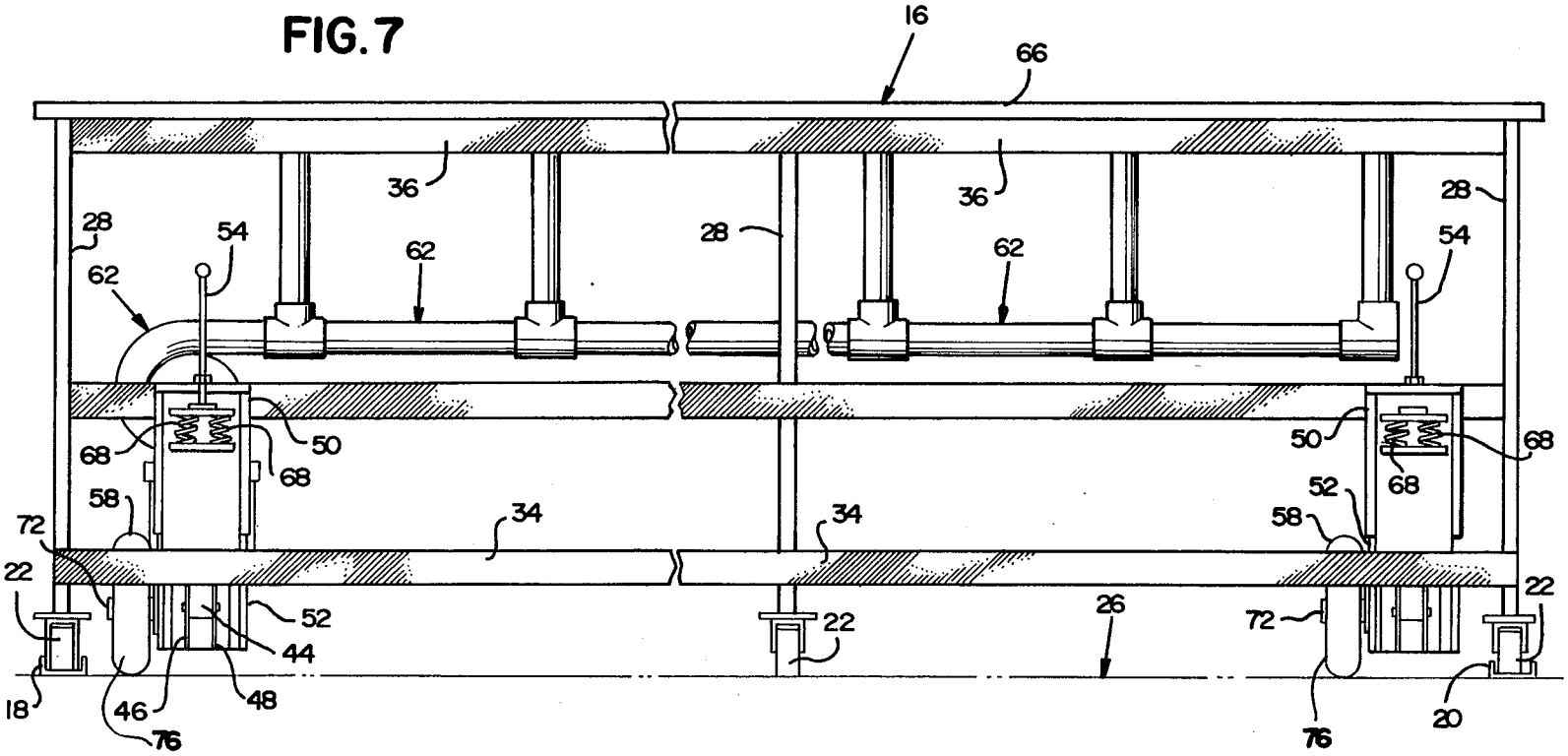
FIG. 7 is a side elevational view of the air equipped table of FIG. 1.

Referring now to FIGS. 3 and 4, a conventional modular, air equipped work table of type well known to those skilled in the art can be conveniently modified to receive near each end a right angle gear motor 56 by employing relatively inexpensive and easily produced bracing members in a readily installed manner without requiring the use of special tools. As shown, a pair of horizontal cross pieces 40, 42 are transversely spaced and bolted to the left and right transverse table braces 32 in spaced relationship above the floor 26. A vertical support 38 is affixed between the table top apron 36 and the transverse brace 32 immediately adjacent to the horizontal cross piece 40 to provide adequate vertical support for the gear motor 56. In the manner illustrated, a top motor mounting bracket 50 is affixed to the horizontal cross piece 40 in a secure, known manner, for example by employing suitable nuts and bolts.

A bottom motor mounting bracket 52 is in telescoping adjustable relationship with the top motor mounting bracket 50 and is vertically adjustable therein by employing a threaded height adjusting bolt 54. Preferably, one or more compression springs 68 bias between the top and bottom motor mounting brackets 50, 52 in known manner to facilitate proper functioning of the right angle gear motor 56. The bottom motor mounting bracket 52 bottomly carries a pair of spaced attachment angles 46, 48 for securing the lower end of the diagonal brace 44. The upper end of the diagonal brace 44 is secured to the horizontal cross piece 42 to thereby provide a firm, sturdy and yet simple securing arrangement for the gear motor 56.

The gear motor 56 is of conventional, rugged, right-angle, single-reduction type and comprises generally an electrical motor 70 which is adapted to turn the output shaft 72 through a suitable reduction gear 74 in well known manner. A floor contacting traction wheel 58 is secured on the output shaft 72 and is rotated when the gearmotor 56 is energized. In the illustrated embodiment, the floor contacting wheel 58 is provided with a suitable molded rubber tire 76 to provide sufficient frictional contact with the floor 26 to move the transfer table 16 over the floor when in either the loaded or unloaded condition.

As seen in the sketch of FIG. 2, a pair of longitudinally spaced, transversely extending floor tracks 18, 20 are provided in a manner to permit the transfer table 16 to be moved respectively into longitudinal alignment with the spreading table 10, the cutting table 12 and the bundling table 14 upon activation of the transfer table propelling system. It is contemplated that the transfer table 16 could be fabricated of infinite length as necessary for job conditions and could be of any suitable width for the job. Preferably, the work tables 10, 12, 14 and the transfer table 16 should be fabricated to the same dimensions to facilitate load transfer from table to table. At the present time, modular table sections of four foot length and of various widths are currently available from Phillocraft Company, Montgomeryville, Pa., the assignee of the present application.

Transfer tables up to sixty feet in length have been successfully operated by employing two right angle gearmotor drives 56, one such gearmotor being mounted at each end of the table in the manner hereinbefore described. Power for the gearmotors can be taken from the conventional overhead trolley system (not illustrated) which is normally in place in most large garment manufacturing facilities. A switch 60 of conventional design may be affixed to the table top apron 36 in known manner in a convenient location to allow a single operator to readily transversely move the transfer table 16 when desired. Preferably, the controls for the transfer table flower system 62 will similarly be conveniently located in known manner to allow the single operator to have complete control of the table operation.

In use, upon completion of the spreading operations on the spreading table 10, the transfer table 16 can be moved along the floor guide tracks 18, 20 until the transfer table 16 is in longitudinal alignment with the spreading table 10 in the manner illustrated in FIG. 2. With the table so positioned, the flower systems 62 on both the spreading table 10 and the transfer table 16 can be energized to force air under pressure through the plurality of table top openings 64 to thereby provide a boundary layer of pressurized air at the top surface 66 of each of the tables 10, 16. The air provided by the blower systems 62 renders the layered, spread fabric essentially weightless whereby a single operator can urge the entire spread (not illustrated) longitudinally from the spreading table 10 to the transfer table 16. Once the transfer of the fabric has been completed, the flower systems 62 on each table 10, 16 can be deenergized and the drum switch 60 on the transfer table can then be operated to actuate the gearmotors 56 which are positioned at each end of the transfer table 16.

Activation of the gearmotors 56 causes the respective floor contacting wheels 76 to rotate, thereby urging the transfer table 16 transversely along the floor tracks 18, 20 until the transfer table 16 is positioned in longitudinally juxtaposed relationship to the cutting table 12. Once in this location, the switch 60 is again operated to deenergize the gearmotors 56. The reduction gearing of the gearmotors will serve substantially as a brake so that the table 16 will tend to remain in its longitudinally aligned position. It is noteworthy that at this position, the spreading table 10 will be entirely free of the previous spread and accordingly, the plant operator can then again activate the automatic spreading equipment (not illustrated) to substantially continuously utilize the expensive spreading equipment during the time that the cutting and bundling operations are progressing at the other tables 12, 14.

Once the transfer table 16 has been aligned with the cutting table 12, the operator can again operate the flower systems 62 on both tables 12, 16 to thereby again allow the single operator to transfer the spread from the transfer table to the cutting table. Once the layered fabric spread is properly positioned upon the cutting table 12, the blower systems 62 on both tables will be deactivated to thereby rest the load entirely on the cutting table whereon the usual cutting operations, either manual, semi-automatic or completely automatic in nature can then take place.

Similarly, upon completion of the cutting operations on the cutting table 12, the air systems 62 of the cutting table 12 and the transfer table 16 can again be energized to allow the operator to move the cut spread from the cutting table to the transfer table 16. In this regard, it is noteworthy that it is usual to provide a small, peripheral selvage about the periphery of the layered fabric and so there will be no tendency of the cut material to separate during transfer from table to table. Once the cut material is in position above the transfer table 16, the respective blower systems 62 can be deenergized and the transfer table 16 can be moved along the tracks 18, 20 upon energization of the gearmotors 56 into longitudinal alignment with the bundling table 14. Here again, it is noteworthy that once the cut spread has been transferred from the cutting table 12 to the transfer table 16, the cutting table and its associated cutting apparatus (not illustrated) will again be free to receive another stack of layered fabric in a manner to provide substantially continuous utilization of the costly cutting equipment.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather, only by the scope of the claims appended hereto.

What is claimed is:

1. A transfer table system for transferring stacked layers of fabric above a floor from one table to another comprising a plurality of stationary work tables positioned upon the floor, each work table having a longitudinal axis, the work tables being positioned in spaced relationship with their longitudinal axes in parallel, each work table having a top provided with a plurality of first openings and first blower system means in fluid communication with the first openings to provide a first boundary layer of pressurized air above the work table top;

a transfer table movable over the floor and having a longitudinal axis, the longitudinal axis of the transfer table being parallel to the longitudinal axes of the work tables, the transfer table having a top provided with a plurality of second opening and second blower system means in fluid communication with the second openings to provide a second boundary layer of pressurized air above the transfer table top, the transfer table comprising a plurality of table supporting wheels and motor means to rotatively power at least one of the wheels to move the transfer table over the floor sufficiently to selectively align the longitudinal axis of the transfer table with the longitudinal axis of each of the work tables;

track means secured to the floor adjacent to the work tables to control movement of the transfer table, the track means extending at right angles to the respective said longitudinal axes, the track means being adapted to receive and guide at least one of the transfer table wheels; and a heavy, flexible load comprising a plurality of stacked layers of fabric maintained above the top of one of the tables, and being adapted to be transferred between the transfer table and a work table, the heavy, flexible load being supported upon the first boundary layer of air when above a work table and being supported upon the second boundary layer of air when maintained above the transfer table.

2. The transfer table system of claim 1 wherein the at least one powered transfer table wheel contact the floor and does not contact the track means.

* * * * *